US006279686B1

(12) United States Patent
Kaup

(10) Patent No.: US 6,279,686 B1
(45) Date of Patent: Aug. 28, 2001

(54) ATTACHMENT FOR FLOOD AND YARN TRUCKS WITH A LIFT MAST, ESPECIALLY FOR FORK LIFT TRUCKS

(75) Inventor: Otmar Kaup, Aschaffenburg (DE)

(73) Assignee: Kaup GmbH & Co., KG, Braunstrasse (DE)

( * ) Notice: Subject to any disclaimer, the term of this patent is extended or adjusted under 35 U.S.C. 154(b) by 0 days.

(21) Appl. No.: 09/490,407

(22) Filed: Jan. 24, 2000

(30) Foreign Application Priority Data

Jan. 27, 1999 (DE) ..... 199 03 157

(51) Int. Cl.[7] ..... B66B 1/20

(52) U.S. Cl. ..... 187/285; 187/227; 414/607; 414/912

(58) Field of Search ..... 187/285, 222, 187/224, 225, 226, 227, 230, 233, 237, 238; 414/607, 912, 420, 422

(56) References Cited

U.S. PATENT DOCUMENTS

| | | | | |
|---|---|---|---|---|
| 4,395,188 | * | 7/1983 | Kaup | 414/622 |
| 4,618,306 | * | 10/1986 | Dorch | 414/420 |
| 4,999,902 | * | 3/1991 | Schumacher et al. | 187/95 |
| 5,174,415 | * | 12/1992 | Neagle et al. | 187/9 R |
| 5,462,136 | * | 10/1995 | Schoenmaker et al. | 187/223 |
| 5,496,147 | * | 3/1996 | Taube | 414/607 |
| 5,788,452 | * | 8/1998 | Brouwer et al. | 414/631 |
| 5,890,563 | * | 4/1999 | Avitan et al. | 187/228 |
| 5,913,654 | * | 6/1999 | Kaup | 414/667 |
| 6,182,797 | * | 2/2001 | Tebbe et al. | 187/227 |

FOREIGN PATENT DOCUMENTS

| | | |
|---|---|---|
| 3125384 | 1/1983 | (DE) . |
| 4041846 | 6/1992 | (DE) . |

OTHER PUBLICATIONS

VDI 3586—Mar. 1996.

VDI 3642—Mar. 1988.

* cited by examiner

*Primary Examiner*—Jonathan Salata
(74) *Attorney, Agent, or Firm*—Fulbright & Jaworski, LLP

(57) ABSTRACT

Attachments for floor and yard trucks with a lift mast, especially for fork lift trucks, have a lift carriage (8) which has two side plates (9, 10) and two horizontal beams (12/14, 13) situated one over the other with a clearance ("h") between them, on which there is held at least one hydraulically powered element from the group: load carrier, "transport securing means," rotating device, tilting device, pushing device, pulling device, holding device, lifting device, fork shifting device, lateral shift frame (1), each with the corresponding hydraulic drive (14). The front sides of the horizontal beams (12/14, 13) and the rear edges of the side plates (9, 10) of the lift carriage (8) are disposed between two vertical planes defining between them a space (7) wherein the at least one hydraulic jack (14) is arranged and the corresponding control unit (18) is disposed. To avoid or reduce the number of hydraulic hoses, within the said space (7), in addition to the at least one hydraulic jack (14), there is also at least partially arranged the control unit (18), plus at least one drive means from the group of hydraulic pump **(19*a*), pump motor (19*b*), storage battery, pump sump, pressure accumulator (20)** and radio receiver.

10 Claims, 5 Drawing Sheets

Figure 1:
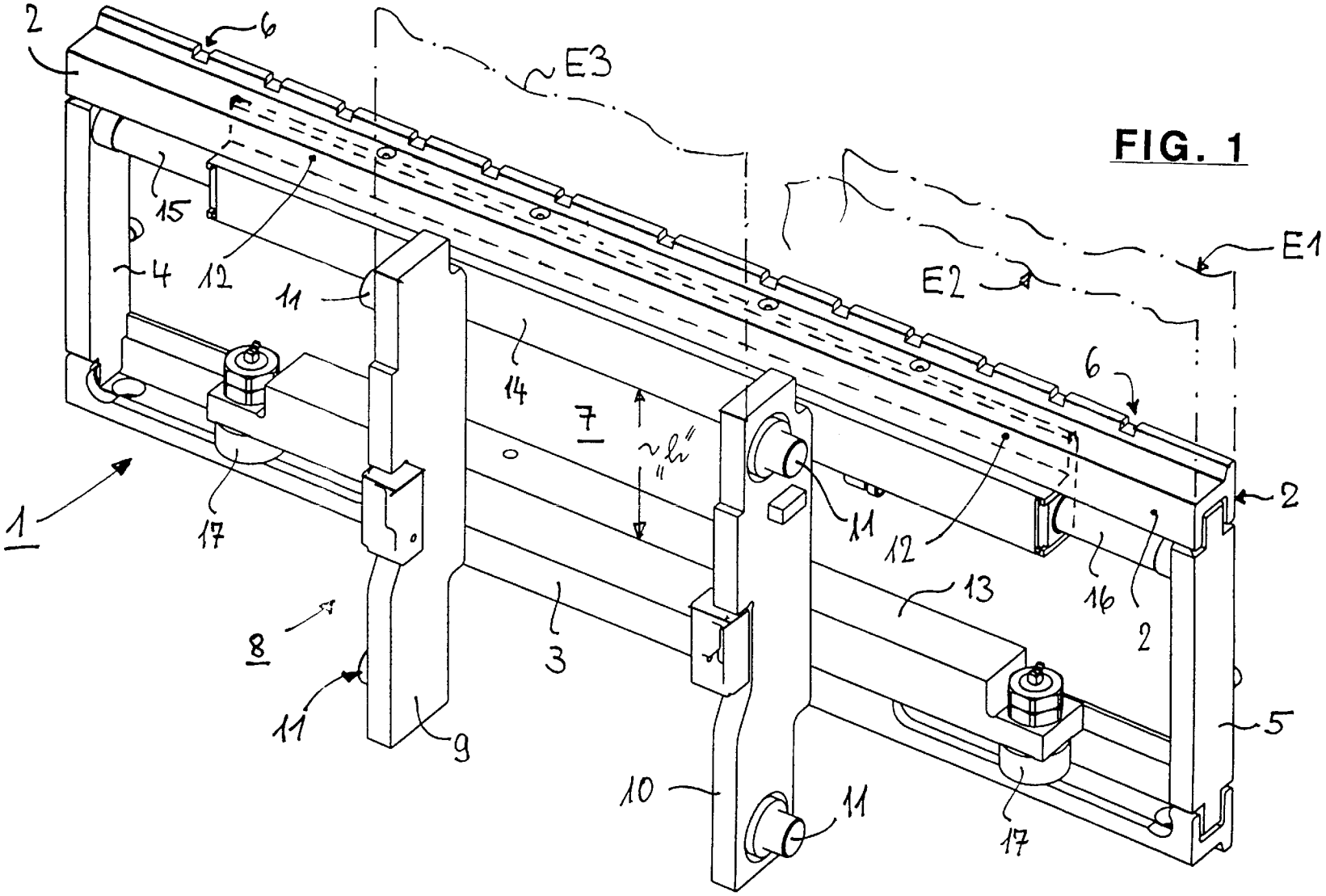

ATTACHMENT FOR FLOOD AND YARN TRUCKS WITH A LIFT MAST, ESPECIALLY FOR FORK LIFT TRUCKS

The invention relates to an attachment for floor and yard trucks with a lift mast, especially for fork lift trucks, with a lift carriage which has two side plates and two horizontal beams situated one over the other with a clearance between them, on which there is held at least one hydraulically powered element from the group of load carrier "transport securing means," rotating device, tilting device, pushing device, pulling device, holding device, lifting device, fork shifting device, lateral shift frame with the corresponding hydraulic drive, the front sides of the horizontal beams being situated in a first vertical plane and the rear edges of the side plates of the lift carriage in a third vertical plane, the said planes defining between them a space wherein the at least one hydraulic jack is arranged, which is connected with one of the horizontal beams of the lift carriage, and at least one control unit being associated with the hydraulic drive.

The subject matter of the invention can be applied advantageously in floor and yard trucks with attachments and built-in hydraulic drives, as they are described in the case of fork lift trucks in VDI Guidelines No. 3578. Accordingly, attachments are accessories which are used for picking up loads, "transport securing means," or load transport. Such apparatus serve for picking up loads from above, in the middle and/or from the bottom, for grasping, turning, pulling and lifting the load, for tilting sideways, forward and backward, for shifting the load forward and transversely, for holding the load at the top and/or the side, and for adjusting the fork spacing.

The following are described as loads: paper rolls, concrete pipes, barrels, bales, goods packed in cartons, bricks, containers and boxes, foundry charges and bulk goods. The carrying capacity of the truck is reduced by the width, the so-called forward size, and the weight of the attachment. This requires a reduction of the said dimensions.

In the VDI Guidelines No. 3586, all materials handling equipment running on the ground (floor) which serve for the local transportation, according to their type, for the transportation, towing, pushing, lifting, stacking or shelving of loads of all kinds, which are driverless, controlled by a pedestrian or by a driver who sits or stands on the vehicle or on a driver's elevator.

Between the truck and the attachment there are provided, as a rule, so-called "interfaces" according to VDI Guidelines No. 3642. These guidelines govern the range of hydraulic pressures and delivery rates as well as the size and arrangement of hydraulic couplings. This necessarily further reduces the gross weight of the attachment and the carrying capacity of the truck and especially increases costs.

The subject matter of the invention is suitable to special advantage not only for lateral shifting systems but also for attachments and accessories according to DE 31 25 384 C2 and DE 40 41 846 A1 of the same Applicant, relating to attachments for fork lift trucks in which the forks are symmetrically shifted hydraulically transversely of their length. In the one described in DE 31 25 384 C2, the forks can also reach individually and additionally in the direction of their length, which requires additional hydraulic drives. Lateral shifting apparatus serve, of course, by the asymmetrical shifting of the load, either to compensate for driving or positioning errors or, after turning the forks by 90 degrees, for pushing the load to the left or right in storage racks. For each individual drive the required hydraulic hoses are to be provided, which ultimately results in "hose trees."

Lateral shifting systems which are classed among the attachments are disclosed by DE 196 02 055 C1 and DE 196 02 553 A1 of the same Applicant; they are entirely hydraulically controlled through valves from the vehicle.

For this purpose the truck is connected by a corresponding number of hydraulic hoses to the lateral shifting drive, and since these hoses must permit the entire movement of the carriage they have a corresponding length and are carried in swags on pulleys, partially on the back of the mast, partially between the posts of the mast and partially also between the side plates of the lift carriage. In view of the height of the masts, which in the case of reach lift trucks can amount to six and more meters, considerable hose lengths are therefore necessary. This entails a series of disadvantages.

Pressure hoses passed around pulleys are subject to great wear. Therefore, DIN 20066, Part 5, which applies to hose lines of fluid technology, mentions that the length of time for which hose lines of this kind, including any storage time, should not exceed six years, and that the storage time itself should not exceed two years. This necessitates from time to time the replacement of the expensive pressure hoses, with all the problems of bleeding and filling up the entire hydraulic system, with the resultant costs.

Another problem is due to the possibility that in such long hoses air inclusions can develop which considerably interfere with operation because they can result in jerky movements of the lateral shifter. One can imagine a load which is situated several meters above the floor on the mast of a fork lift truck and jerking movements of the lateral shifter induce horizontal swaying.

U.S. Pat. No. 4,618,306 discloses a front-end apparatus constructed as an attachment, for tilting barrels, which consists of two hollow longitudinal beams which are rigidly connected together by a base plate. On this base plate, within a large capacity housing, there is a complete hydraulic drive system with accumulators, electric motor, hydraulic pump, oil tank and control unit. This drive system is connected only by electrical control lines to the vehicle, on the instrument panel of which the electrical control switch can be releasably fastened, but is entirely in front of the lift carriage. Due to the considerable depth of the drive unit the forks must be made accordingly longer, and the center of gravity is shifted forward a great distance toward the fork arms, so that the entire arrangement is nose-heavy. Furthermore, a jack is fastened ahead of the attachment for rotating its grabber for the barrels on one of the hollow longitudinal beams. These jacks also move the center of gravity of the attachment still further forward. To accommodate this attachment the lift forks of the truck are inserted into the hollow beams, i.e., the masses of lift forks and longitudinal beams add up with the distance of the load from the lift carriage to a considerable tipping force. The apparatus has no lateral shifting system.

DE 44 15 429 C2 discloses, in the case of an attachment with a lateral shifting system for fork lift trucks, the placement of a rotating device for finished concrete pieces on each of two lift forks. One of these rotating devices has a hydraulic drive which acts on a journal, and the other has a journal which has only an automatic return apparatus. Each of the journals has a shoe-like base body or longitudinal beam into which one of the lift forks is inserted. The hydraulic drive is connected by a quick coupling to the hydraulic system of the truck, and the hydraulic lines are carried over the lift frame. The driving system of the rotating device therefore is not self-sufficient. The reference to a rotary drive independent of the lift truck's hydraulic system says nothing about how it is housed. All of the rotary drives and their components as well as the shoe-like base bodies or longitudinal beams pushed onto the forks are all situated in front of the lift carriage. Here too the considerable structural depth of the hydraulic drive on one of the forks shifts the center of gravity very far towards the fork arms, so that the entire system is front-end heavy. In particular, this hydraulic drive shifts the center of gravity of the attachment still further forward. To receive this attachment the lift forks of the truck are inserted into the longitudinal beams of the rotary drives, i.e., even the masses of long lift forks and longitudinal beams add up with the distance of the load from the lift carriage to a considerable tipping moment.

In contrast, the invention is addressed to the problem of avoiding the location of hydraulic pressure hoses ahead of the lift frame, of using very small and light hydraulic elements with the lowest possible power requirement for driving the attachments, and to reduce the tipping moment of known hydraulic units and/or hydraulic components affecting the stability of the vehicle.

The solution of the stated problem is accomplished in the attachment referred to above by the fact that, in the said space between the first and the third vertical plane, except for the at least one hydraulic drive, also the corresponding control unit and at least one drive element of the group, hydraulic pump, pump motor, accumulator, pump well, pressure accumulator and radio receiver, are at least partially disposed such that the said elements of the hydraulic drive are disposed in back of the first plane.

By the invention it becomes possible to avoid laying hydraulic hoses over the lift frame and to use for the drive of the attachments small and light hydraulic elements requiring little energy. Lengthening the fork arms is not necessary, and the front-end heaviness is considerably reduced below that of the state of the art.

Gear pumps are used preferentially as hydraulic pumps, because they are small and inexpensive; but also axial piston pumps or diaphragm pumps can also be used since they can be powered also by electromagnets.

Control can be operated from the truck through multiple conductor power cables, but also wirelessly through a radio remote control whose transmitter can be operated from the truck. In this case it is especially advantageous if a storage battery is associated with the control unit and also supplies current to operate the pumps.

It is especially advantageous if, either individually or in combination:

the control unit is rigidly joined to the at least one hydraulic drive, in case a lateral shifting frame for fork arms is provided on the horizontal beams, the lateral shift frame has in turn two horizontal rails one over the other, which are carried for lengthwise displacement on the horizontal beams of the lift carriage, and the hydraulic drive and the corresponding control unit for the horizontal shifting of the lateral shift frame is arranged between the said planes, the hydraulic drive is a dual jack with pistons moving in the same sense and if the control unit is a control valve by which the discharge of a hydraulic pump can be connected to one or the other piston according to the direction of movement, a pressure accumulator is disposed in the pressure line between the discharge of the hydraulic pump and the control unit the discharge of the hydraulic pump is routed to a pressure switch by which the hydraulic pump can be stopped after reaching a given pressure in the pressure accumulator, and/or if the hydraulic drive has a dual cylinder with pistons moving in the same sense, if the discharge direction of the hydraulic pump is reversible, and if the control unit has a control valve and two oppositely connected pressure limiting valves.

The additional advantages are stated in the detailed description that follows, which refers to details of a lateral shift system, but without being limited thereto.

Embodiments of the invention are explained below with the aid of FIGS. 1 to 6.

Figure 2:
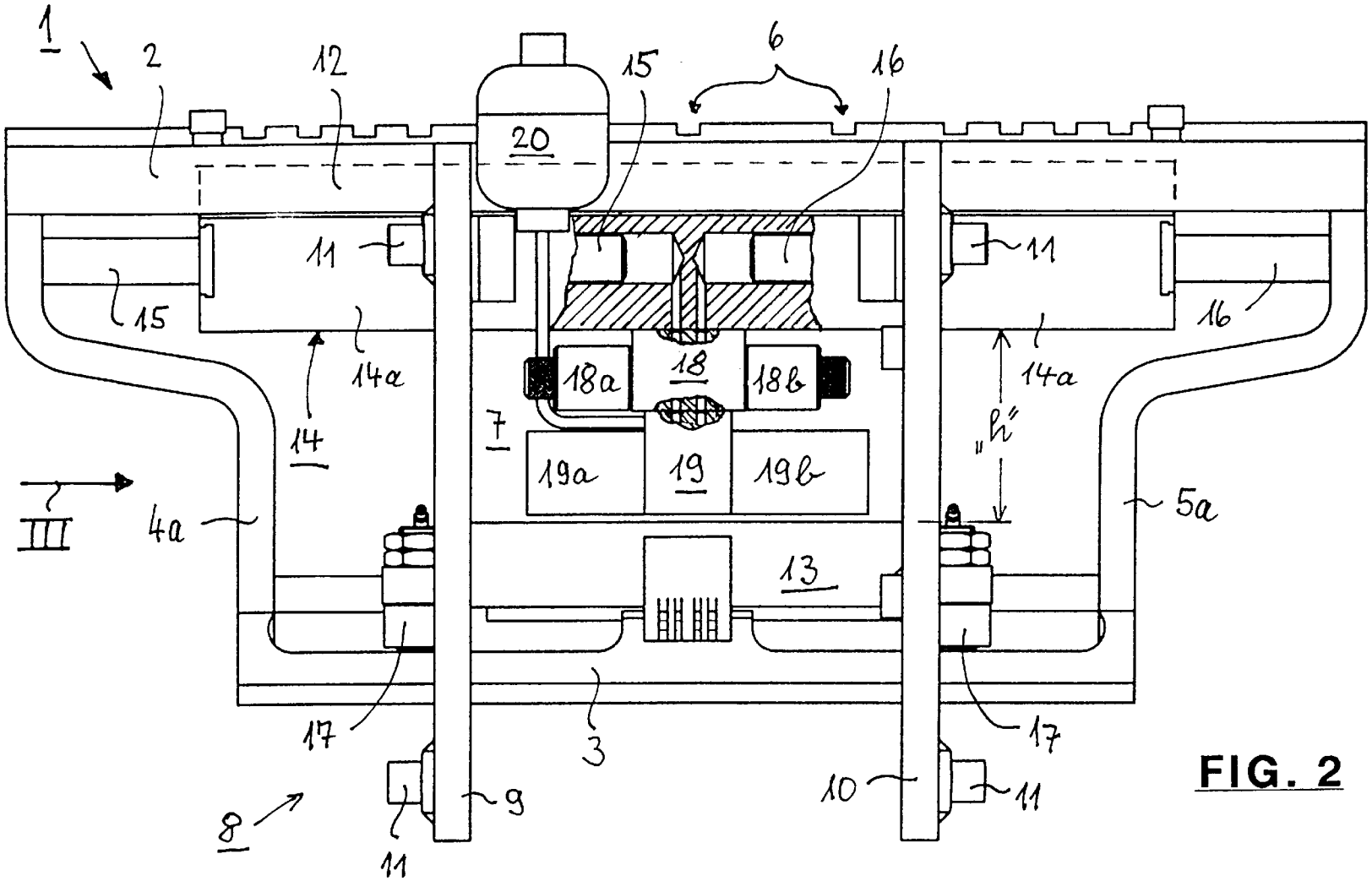
Figure 3:
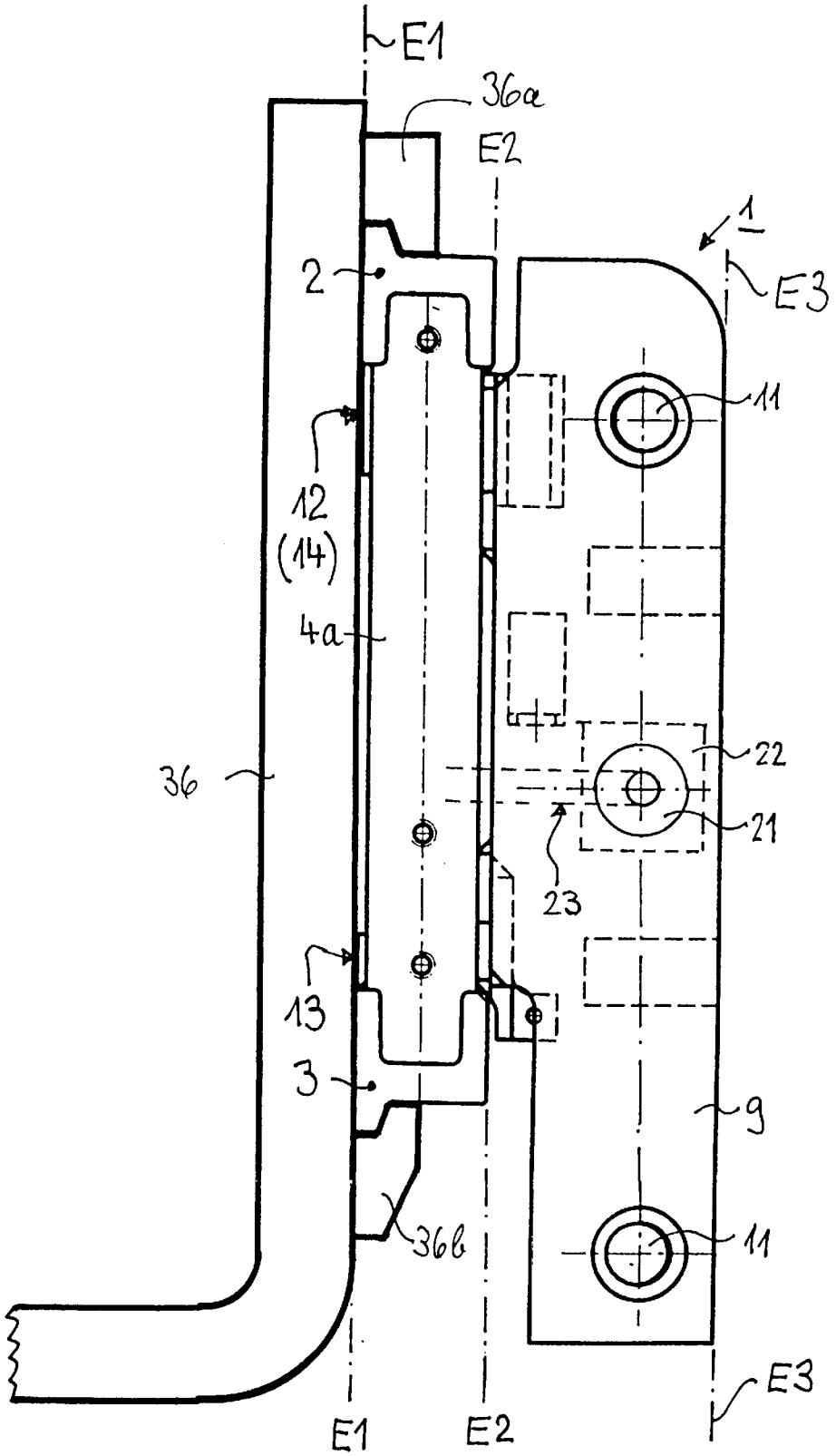
Figure 3A:
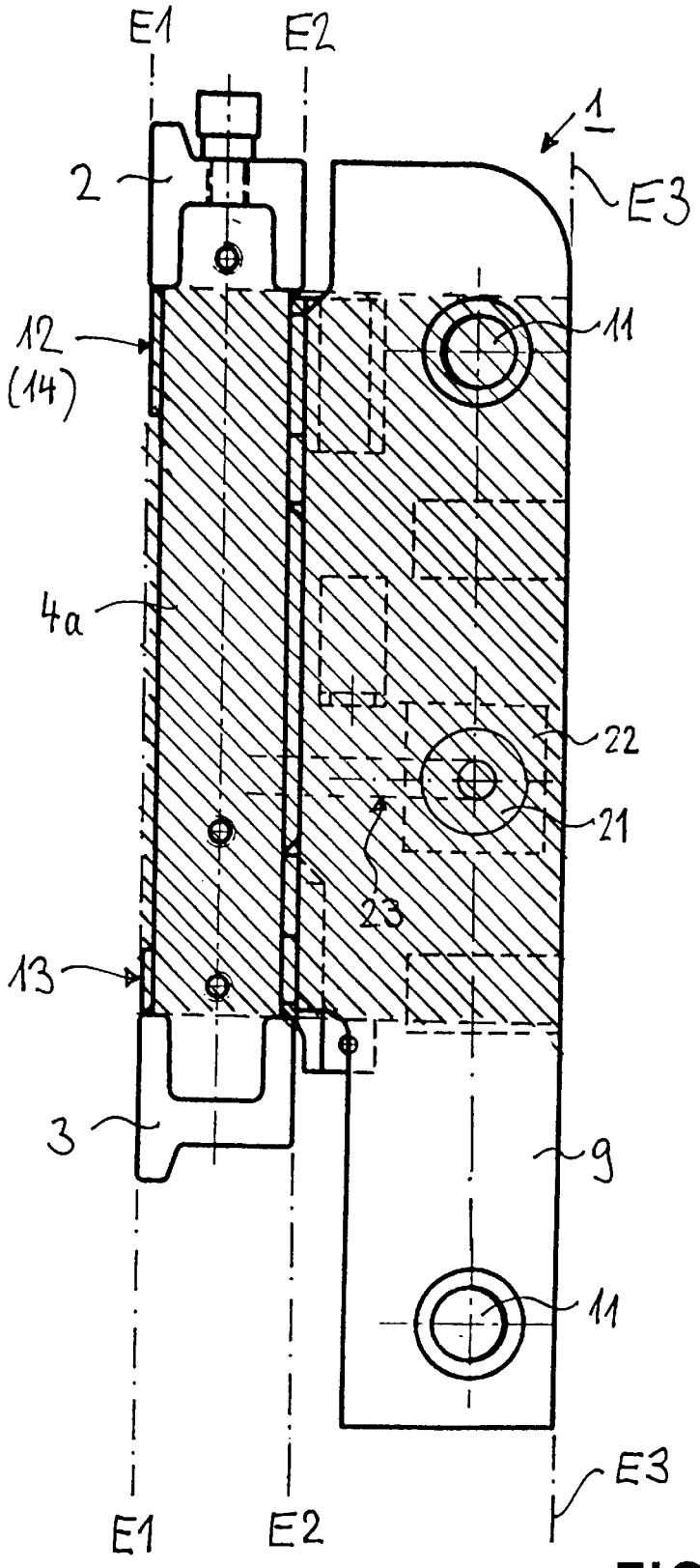
Figure 6:
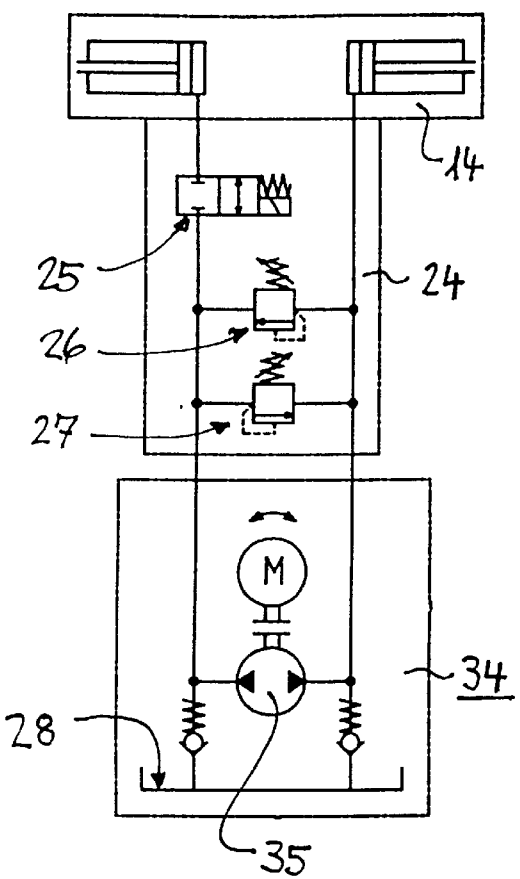
Figure 5:
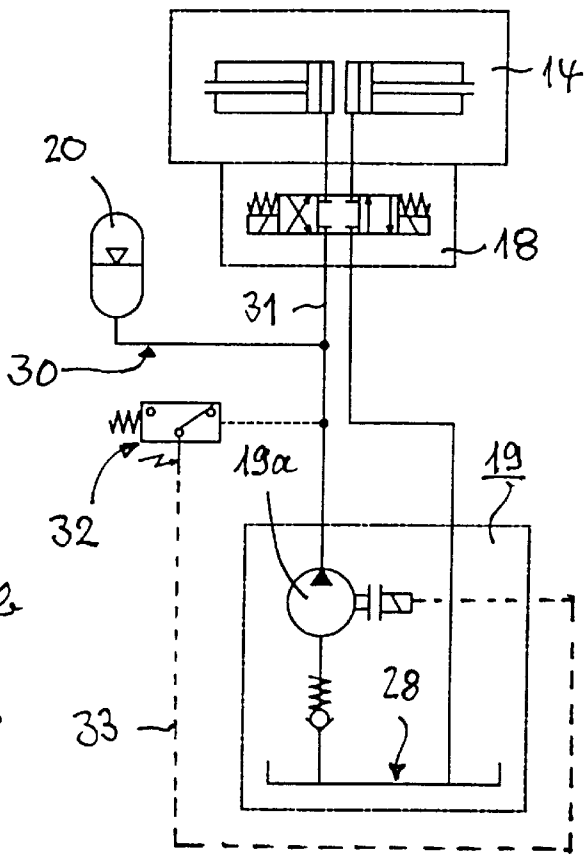
Figure 4:
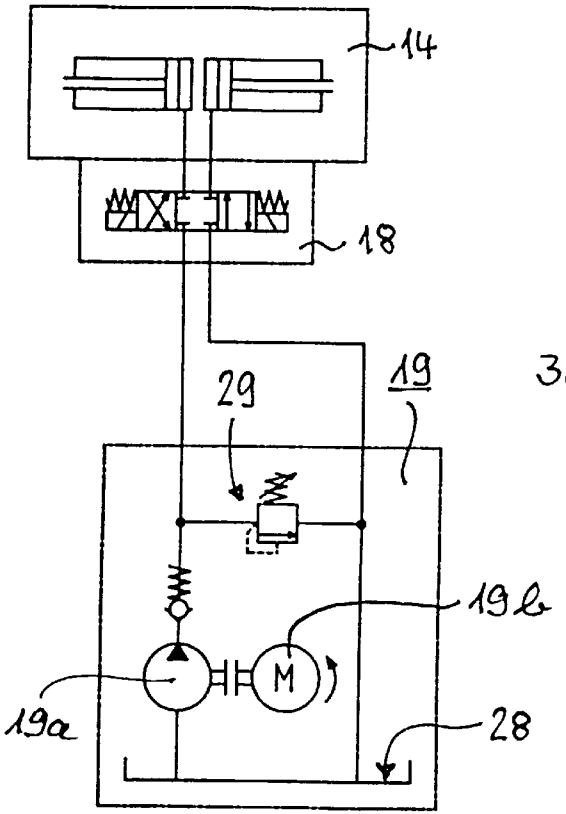

FIG. 1 a perspective representation of a first embodiment of a unit composed of lift carriage, lateral shift frame and horizontally acting hydraulic drive, but without control unit and hydraulic pressure supply, in a view from the rear at an angle, FIG. 2 is a partially fragmentary rear view of a second embodiment of a unit composed of lift carriage, lateral shift frame and horizontally acting hydraulic drive with control unit and hydraulic pressure supply, FIG. 3 a side elevation of the subject of FIG. 2 seen in the direction of the arrow III in FIG. 2, on an enlarged scale, with mounted forks of which only the front one is visible, FIG. 3*a* the subject of FIG. 3 without forks mounted, but with a hatched area for containing at least the important heavy parts of the hydraulic drive, and FIGS. 4 to 6 various hydraulic circuits with control units and hydraulic pressure supply units.

FIG. 1 is intended substantially to explain the structural requirements for containing a control unit and hydraulic pressure supply. A lateral shift frame 1 consists substantially of an upper horizontal rail 2, a lower horizontal rail 3 and two rectilinear vertical members 4 and 5. The upper horizontal rail 2 is provided with notches 6 for the positive suspension of fork arms not shown here. The horizontal rails 2 and 3 are channel-shaped at their confronting sides and with their vertical outer sides they define two vertical parallel virtual planes E1 and E2 running transversely across the direction of travel, whose distance apart corresponds to the profile width of the horizontal rails 2 and 3.

Whenever the terms, "vertical" or "perpendicular" are used hereinafter, these terms are not to be considered strictly geometrically, since departures therefrom can occur and do occur due to the work-related tilting of the lift mast. Reference to "front" and "rear" is related to the direction of travel of the truck on which the lateral shift apparatus is mounted.

The lateral shift frame 1 is carried on a lift carriage 8, which can also be called an apparatus carrier and has two flat side plates 9 and 10 whose rear edges "subtend" a third virtual and vertical plane E3 which in turn runs parallel to the first and second planes E1 and E2. These planes are important aids in determining the definitions according to the invention, which will be explained with the aid of FIGS. 1 and 3. The space 7 defined by the planes E1 and E3 in the direction of travel of the floor and yard truck, not shown, serves at least partially to contain at least a part of the hydraulic elements described further below. Preferably the latter can also be contained in that part of space 7 which lies between the planes E1 and E2, which pass through the front and rear side of the lateral shift frame.

On the outer faces of the side plates 9 and 10, stub shafts 11 are fastened for guide wheels by means of which the lift carriage 8 is guided vertically on a lift mast not shown. The side plates 9 and 10 are connected by an upper horizontal beam 12 and a lower horizontal beam 13 with a clear distance "h" between them, the upper horizontal beam 12 being made in a unit with a double-action hydraulic drive 14, so that these parts stiffen and strengthen one another. The horizontal beams 12 and 13 project on both sides beyond the side plates 9 and 10.

The upper surface of the horizontal beam 12, equipped with slides, is covered by the upper horizontal rail 2 of the lateral shift frame 1 and is therefore represented in broken lines. The hydraulic drive 14 has two pistons 15 and 16 which are in the form of plunger pistons and abut against the vertical members 4 and 5 of the lateral shift frame 1. The extendable length of pistons 15 and 16 determines the maximum horizontal movement of the lateral shift frame 1. This maximum movement can amount to between 50 and 250 mm from a middle position to both sides.

Details of such lateral shift systems are described in DE 196 02 055 C1 and in DE 196 02 553 A1, so there is no need to explain them here.

The two ends of the lower horizontal beam 13 are provided with wheels 17 on which the front flange of the lower horizontal rail 3 of the lateral shift frame 1 is supported. Its rear flange is cut out at both ends in the range of movement of the wheels 17. Also the horizontal beams 12 (with the hydraulic drive 14) and 13 lie at least substantially between the imaginary planes E1 and E2 as defined.

In FIGS. 2, 3 and 3*a* the same reference numbers are used for equal parts or parts with an equal function. In contrast to FIG. 1, the straight vertical members 4 and 5 are replaced by vertical members 4*a* and 5*a*, cranked in mirror-image symmetry.

In the space 7 defined fore and aft by planes E1 and B2 (see FIGS. 1, 3 and 3*a*) there is situated—from top down—first the double-action hydraulic drive 14 with a continuous or one-piece cylinder body 14*a* and the two pistons 15 and 16. The inner ends of the unnumbered cylinder bores are at the shortest possible axial distance apart, as is represented also in DE 196 02 055 C1 and in DE 196 02 553 A1. In the present case, however, the radial connecting bores are situated as closely as possible to one another, so that a control unit 18 in the form of an electromagnetically operated control valve can be flange-mounted on the hydraulic drive 14 with the magnetic drivers 18*a* and 18*b* and with three positions, i.e., without the interposition of hydraulic hoses.

Thereunder, and within the space 7, there is again a pump unit 19 with a hydraulic pump 19*a* and an electric motor 19*b*. The pump sump and a tank are not especially represented, but they are also contained in space 7. See FIGS. 4 to 6 in this regard. Neither are the electric lines to the control unit 18 and the pump motor 19*b* shown.

The width (across the direction of travel) of control unit 18 and pump block 19 is not limited to the space between the side plates 9 and 10; it is necessary only to be sure that the vertical members 4/4*a* and 5/5*a* can never collide.

In further embodiment of the invention, the line from a pressure accumulator 20 can enter between the control unit 18 and the pump block 19. Since the pressure accumulator does not require a long pressure line it can also be arranged on the lift carriage outside of the space 7, as shown in FIG. 2. The pressure accumulator offers the following advantage: since it can be charged also in the pauses in the lateral shift movement, i.e., over long periods of time, the output of the pump block 19 can be reduced and thus its dimensions can be reduced. In borderline cases this acts considerably against housing the other hydraulic elements in the space 7. Also in the case of the use of storage batteries (accumulators) the use of a pressure accumulator offers advantages.

The dimensions of the individual hydraulic elements are allowed to exceed the depth of space 7 and this is not critical as long as interferences and/or contact with other structural elements do not occur. For example, it is possible to use still another part of the depth of the space between the side plates 9 and 10 to contain hydraulic elements.

Such a possibility is explained with the aid of FIG. 3. In the side plate 9 of the lift carriage 1 there is a drive roll 21 between the stub shafts 11, which is driven by the vertical movement of the lift carriage 1 against the lift mast, not shown, either by friction or positively, for example by engaging a rack or roller chain, neither of them shown. The rotation of the drive roll 21 can be transmitted either directly to a hydraulic pump 22, or through transmission means 23 to a pump which is housed within the space 7 between the planes E1 and E2. One of the forks 36 is removably fastened to the horizontal rails 2 and 3 by means of hooks 36*a* and 36*b*.

FIG. 3*a* shows the subject of FIG. 3 without the forks attached, but with a hatched area for housing at least the important heavy parts of the hydraulic drive.

In FIGS. 4 to 6 are shown the simply operating hydraulic drives 14 with disk pistons and connecting rods, but this changes nothing in the principle of the design. In FIGS. 4 and 5 the control units 18 are configured and represented as control valves with three positions. In FIG. 6 the control unit 24 consists of a magnetically operated control valve 25 with two positions and two directly operated pressure limiting valves 26 and 27 in an antiparallel relationship. The control units 18 and 24 are directly flanged to the hydraulic drives 14.

In FIG. 4, the pump block 19 contains a pump sump 28 and a directly controlled pressure limiting valve 29. In FIG. 5 such an arrangement is supplemented by a pressure accumulator 20 whose in-and-out line 30 is connected to the pump discharge line 31 between the hydraulic pump 19*a* and the control unit 18. A hydroelectric pressure switch 32 limits the pressure in the pressure accumulator 20 and accordingly operates the electric motor of the hydraulic pump 19*a* through an electrical line 33. In FIG. 6 a hydraulic pump 35 with two rotatory and pumping directions is provided.

In the claims and in the description, at least one hydraulic drive and one corresponding control unit are involved. It is to be understood, therefore, that the attachment can also have additional auxiliary apparatus and/or additional functions, so that several hydraulic drives, each with corresponding control units and control valves, can be provided. Furthermore, it is to be understood that, in addition to the hydraulic drives, electric motor drives and corresponding control units can be provided, as for example rotary drives for rotary apparatus which can be powered purely electrically and can contain electric motors and reduction drives, for example.

What is claimed is:

1. Attachment for floor and yard trucks with a lift mast, especially for fork lift trucks, with a lift carriage (8) guided on the lift mast, which has two horizontal beams (12, 13) lying at a clear distance ("h") one above the other, on which there is held at least one hydraulically powered element from the group: load carrier, transport securing means, turning device, tipping device, pushing device, pulling device, holding device, lifting device, fork adjusting device, and lateral shifting frames with hydraulic drive corresponding to each, is held, wherein the front sides of the horizontal beams (12, 13) lie in a first vertical plane (E1) and the back edges of the side plates (9, 10) of the lift carriage (8) lie in a third vertical plane (E3), the said planes (E1, E3) defining between them a space (7) in which the at least one hydraulic drive (14) is disposed, which is connected with one of the horizontal beams (12) of the lift carriage (8), and wherein at least one control unit (18, 24) is associated with the hydraulic drive, characterized in that within the said space (7) between the first (E1) and the third vertical plane (E3), in addition to the at least one hydraulic drive (14), also the corresponding control unit (18, 24) and at least one drive element from the group: hydraulic pump (19*a*, 35), pump motor (19*b*), storage battery, pump sump (28), pressure accumulator (20) and radio receiver, are at least partially disposed, such that the said elements of the hydraulic drive are disposed in back of the first plane (E1).

2. Attachment according to claim 1, characterized in that the control unit (18, 24) is rigidly attached to the at least one hydraulic drive.

3. Attachment according to claim 1, characterized in that the horizontal beam (12) and the cylinder body (14*a*) of the at least one hydraulic drive (14) are made in one piece.

4. Attachment according to claim 1, characterized in that, in the case of arrangement of one lateral shift frame (1) for fork arms on the horizontal beams (12, 13) of the lateral shift frame (1) has in its turn two horizontal rails (2, 3) lying one over the other, which are guided for longitudinal displacement on the horizontal beams (12, 13) of the lift carriate (8), and that the hydraulic drive (14) and the corresponding control unit (18, 24) for the horizontal shifting of the lateral shift frame (1) is disposed between the planes (E1, E3).

5. Attachment according to claim 1, characterized in that the hydraulic drive (14) has a dual cylinder with pistons (15, 16) moving in the same sense, and that the control unit (18, 24) is a control valve by which the discharge end of a hydraulic ump (19*a*, 35) can be switched to the one or the other piston (15, 16) according to the direction of movement.

6. Attachment according to claim 1, characterized in that in the pressure line (31) between the discharge end of the hydraulic pump (19*a*, 35) and the control unit (18, 24) a pressure accumulator is disposed.

7. Attachment according to claim 1, characterized in that the discharge end of the hydraulic pump (19*a*) is switched to a pressure switch (32) by which the hydraulic pump (19*a*) is stopped after a given pressure is reached in the pressure accumulator (20).

8. Attachment according to claim 1, characterized in that the hydraulic drive (14) has a dual cylinder with pistons (15, 16) moving in the same sense, that the pumping direction of the hydraulic pump (35) is reversible, and that the control unit (24) has a control valve (25) and two oppositely connected pressure limiting valves (26, 27).

9. Attachment according to claim 1, characterized in that the control unit (18, 24) can be operated from the floor and yard truck via electrical lines.

10. Attachment according to claim 1, characterized in that the control unit (18, 24) can be operated by radio remote control.

* * * * *